US010041759B2

(12) United States Patent
Faifer

(10) Patent No.: US 10,041,759 B2
(45) Date of Patent: Aug. 7, 2018

(54) PISTOL GRIP AND CONVERSION KIT

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 15/224,411

(22) Filed: Jul. 29, 2016

(65) Prior Publication Data

US 2017/0030677 A1 Feb. 2, 2017

Related U.S. Application Data

(60) Provisional application No. 62/199,224, filed on Jul. 30, 2015.

(51) Int. Cl.
*F41C 23/10* (2006.01)
*F41A 9/59* (2006.01)

(52) U.S. Cl.
CPC ..... *F41C 23/10* (2013.01); *F41A 9/59* (2013.01)

(58) Field of Classification Search
CPC .... F41A 9/65; F41A 9/66; F41C 23/10; F41C 23/16
USPC ..... 42/7, 50
See application file for complete search history.

(56) References Cited

U.S. PATENT DOCUMENTS 2,140,880 A 12/1938 Osborn
2,236,736 A 4/1941 Scott
2,659,994 A * 11/1953 Yale ..... F41A 3/64 42/16
3,235,997 A 2/1966 Stoner
5,388,362 A 2/1995 Melcher
5,711,103 A 1/1998 Keng
6,289,622 B1 9/2001 Desch, Jr. et al.
6,622,416 B2 9/2003 Kim
6,641,277 B2 11/2003 Smith
6,655,069 B2 12/2003 Kim
6,663,071 B2 12/2003 Peterson
6,763,627 B1 7/2004 Kaempe
6,782,791 B2 8/2004 Moore
6,785,997 B2 9/2004 Oz
(Continued)

FOREIGN PATENT DOCUMENTS

DE 444 295 * 5/1927
RU 2406958 C2 12/2010
(Continued)

OTHER PUBLICATIONS

ISR, PCT/IB2016/001207, filed Dec. 22, 2016, Faifer.

*Primary Examiner* — Stephen Johnson
(74) *Attorney, Agent, or Firm* — Law Office of Arthur M. Antonelli, PLLC

(57) ABSTRACT

A replacement grip for a Makarov pistol which include a body. The body may include a first lever connected to a first interior side wall, the first lever may a first end portion adjacent the top end portion of the body and a second end portion, proximate the bottom end portion. The second end portion may include a projection extending toward a second interior side wall. The first lever may be movable about between a first position and a second position such that in the first position the projection is spaced a first distance from the third interior side wall, and such that in the second position the projection is spaced a second distance from the third interior side wall, the second distance being less than the first distance. When installed on a Makarov pistol, the first lever may be used to release the magazine catch.

20 Claims, 13 Drawing Sheets

(56) References Cited

U.S. PATENT DOCUMENTS

| | | | |
|---|---|---|---|
| 6,817,728 | B2 | 11/2004 | Goko |
| 6,843,015 | B2 | 1/2005 | Sharp |
| 6,952,895 | B1 * | 10/2005 | Zonshine ..... F41A 17/36 42/18 |
| 7,032,494 | B2 | 4/2006 | Wygant |
| 7,111,424 | B1 | 9/2006 | Moody et al. |
| 7,117,624 | B2 | 10/2006 | Kim |
| 7,117,627 | B2 | 10/2006 | Woodmansee, III et al. |
| 7,121,034 | B2 | 10/2006 | Keng |
| 7,197,844 | B2 | 4/2007 | Benson |
| D542,446 | S | 5/2007 | DiCarlo et al. |
| 7,273,292 | B2 | 9/2007 | Kim |
| D566,219 | S | 4/2008 | Moody et al. |
| D566,220 | S | 4/2008 | Moody et al. |
| 7,409,791 | B2 | 8/2008 | Moody et al. |
| 7,421,815 | B1 | 9/2008 | Moody et al. |
| D585,517 | S | 1/2009 | Faifer et al. |
| 7,490,429 | B2 | 2/2009 | Moody et al. |
| 7,523,583 | B2 | 4/2009 | Cheng |
| 7,559,167 | B1 | 7/2009 | Moody et al. |
| 7,568,304 | B1 | 8/2009 | Moody et al. |
| 7,584,568 | B1 | 9/2009 | Brownlee |
| 7,621,065 | B2 | 11/2009 | Gablowski |
| 7,665,239 | B1 | 2/2010 | Moody et al. |
| 7,669,357 | B2 | 3/2010 | Moody et al. |
| 7,685,761 | B2 | 3/2010 | Wu |
| D617,863 | S | 6/2010 | Moody et al. |
| 7,731,380 | B2 | 6/2010 | Wu |
| 7,736,013 | B2 | 6/2010 | Griffin |
| 7,743,545 | B1 | 6/2010 | Moody et al. |
| 7,823,312 | B2 | 11/2010 | Faifer |
| 7,823,855 | B2 | 11/2010 | Faifer |
| 7,837,346 | B2 | 11/2010 | Griffin |
| D633,163 | S | 2/2011 | Fitzpatrick et al. |
| 7,900,390 | B2 | 3/2011 | Moody et al. |
| 7,909,301 | B2 | 3/2011 | Faifer |
| D642,651 | S | 8/2011 | Faifer |
| D643,497 | S | 8/2011 | Fitzpatrick et al. |
| 7,987,623 | B1 | 8/2011 | Moody et al. |
| 7,987,625 | B1 | 8/2011 | Moody et al. |
| D644,707 | S | 9/2011 | Faifer |
| 8,069,603 | B2 | 12/2011 | Moody et al. |
| 8,109,032 | B2 | 2/2012 | Faifer |
| D660,934 | S | 5/2012 | Faifer |
| 8,707,604 | B2 | 4/2014 | Troy et al. |
| 9,354,012 | B2 | 5/2016 | Faifer et al. |
| 2005/0241206 | A1 | 11/2005 | Teetzel et al. |
| 2006/0278797 | A1 | 12/2006 | Keng et al. |
| 2008/0052979 | A1 | 3/2008 | Lee et al. |
| 2008/0209789 | A1 | 9/2008 | Oz |
| 2009/0038199 | A1 | 2/2009 | Oz |
| 2009/0038200 | A1 | 2/2009 | Keng |
| 2009/0194088 | A1 | 8/2009 | Tippmann, Jr. et al. |
| 2009/0288323 | A1 | 11/2009 | Moody et al. |
| 2010/0031552 | A1 | 2/2010 | Houde-Walter |
| 2010/0229452 | A1 | 9/2010 | Suk |
| 2011/0047850 | A1 | 3/2011 | Rievley et al. |
| 2011/0255270 | A1 | 10/2011 | Gross et al. |

FOREIGN PATENT DOCUMENTS

| | | | |
|---|---|---|---|
| RU | 163231 | U1 | 7/2016 |
| WO | WO 2017/017528 | A1 | 2/2017 |

* cited by examiner

PISTOL GRIP AND CONVERSION KIT

CROSS REFERENCE TO RELATED APPLICATIONS

This application claims the benefit of U.S. Provisional Application No. 62/199,224 filed on Jul. 30, 2015. U.S. Provisional Application No. 62/199,224 is incorporated by reference herein in its entirety.

FIELD OF THE INVENTION

The invention generally relates to a replacement grip for a pistol. More particularly, the invention relates to a pistol grip with a magazine catch release for a pistol with a heal catch release.

BACKGROUND

Makarov pistols were widely used by the Soviet Union as service weapons for the police and military from approximately 1951 to 1991. Militaries and police forces may continue to use these pistols as service weapons today. Accordingly, the Makarov pistol may be considered an icon of Russian firearm design, and may possess an enduring reputation for reliability, economy, ease of manufacturing, and reasonable stopping power. As such, the Makarov pistol may include a heal clip magazine release, which reportedly was designed for two handed operation to promote reliable operation during combat.

SUMMARY

Hence, the present disclosure is directed toward a replacement grip for a Makarov pistol which includes a magazine catch release that may provide one handed operation of the heal clip magazine release. Hence, the grip may be for a gun with a frame having an upper portion and a lower portion, a slide connected to the upper portion of the frame, an ammunition magazine receptacle situated within the lower portion of the frame, and a spring secured to the frame. The spring may include a lower end adjacent to the lower end portion of the frame.

In one embodiment, the grip for the gun may include a body which includes a top end portion, a bottom end portion spaced from the top end portion along a first longitudinal axis, an exterior surface extending from the top end portion to the bottom end portion, a first interior side wall, a second interior side wall opposite the first interior side wall, and a third interior side wall disposed between the first interior side wall and the second interior side wall. The third interior side wall may include an intermediate region, a bore extending from the exterior surface to the intermediate region, and an inferior pocket located between the intermediate region and the bottom end portion.

The body may include a first lever connected to the first interior side wall, the first lever including a first end portion adjacent the top end portion of the body and a second end portion, proximate the bottom end portion. The second end portion may include a projection extending toward the second interior side wall. The first lever further may include a first interior side wall attachment site located between the first end portion and the second end portion. The first lever may be movable about the first interior side wall attachment site between a first position and a second position such that in the first position the projection is spaced a first distance from the third interior side wall, and such that in the second position the projection is spaced a second distance from the third interior side wall, the second distance being less than the first distance.

The first interior side wall may include a first elongated recess and the first lever may be connected to the first interior side wall within the first elongated recess. The first elongated recess may include a front wall adjacent the first interior side wall, and a rear wall adjacent the first interior side wall. The first lever may be pivotally connected to the first interior side wall such that in the first position the first end portion is proximate the rear wall, and such that in the second position the first end portion is proximate the front wall.

The first lever may have a mechanical advantage greater than 1.0. Preferably, the grip may have a mechanical advantage greater than 2.0. More preferably, the first lever may have a mechanical advantage substantially equal to 2.2.

The first end portion of the first lever may include an actuation surface. The actuation surface may project away from the exterior surface of the body. The body further may include an opening extending from the exterior surface to the first interior side wall. The actuation surface may be disposed in the first opening.

The first opening may be an indentation in the top end portion of the body. The first opening may include a rim extending from the exterior surface to the first interior side wall. The rim may form a curve. The curve may have a radius centered at the first interior side wall attachment site. For example, the radius may be substantially equal to 50 mm.

The first interior side wall may be on the port side of the grip. The body may further include a shim connected to the second interior side wall. Alternatively, the first interior side wall may be on the starboard side of the grip. The body may include a second lever connected to the port interior side wall or a shim connected to the second interior side wall.

A pistol grip conversion kit for a Makarov variant pistol may include a grip in accordance with this disclosure, a second lever configured and dimensioned to be connected to the second interior side wall; a first shim configured and dimensioned to be connected to the first interior side wall; a second shim configured and dimensioned to be connected to the second interior side wall; and instructions for replacing a Makarov pistol grip with a grip described in accordance herein.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
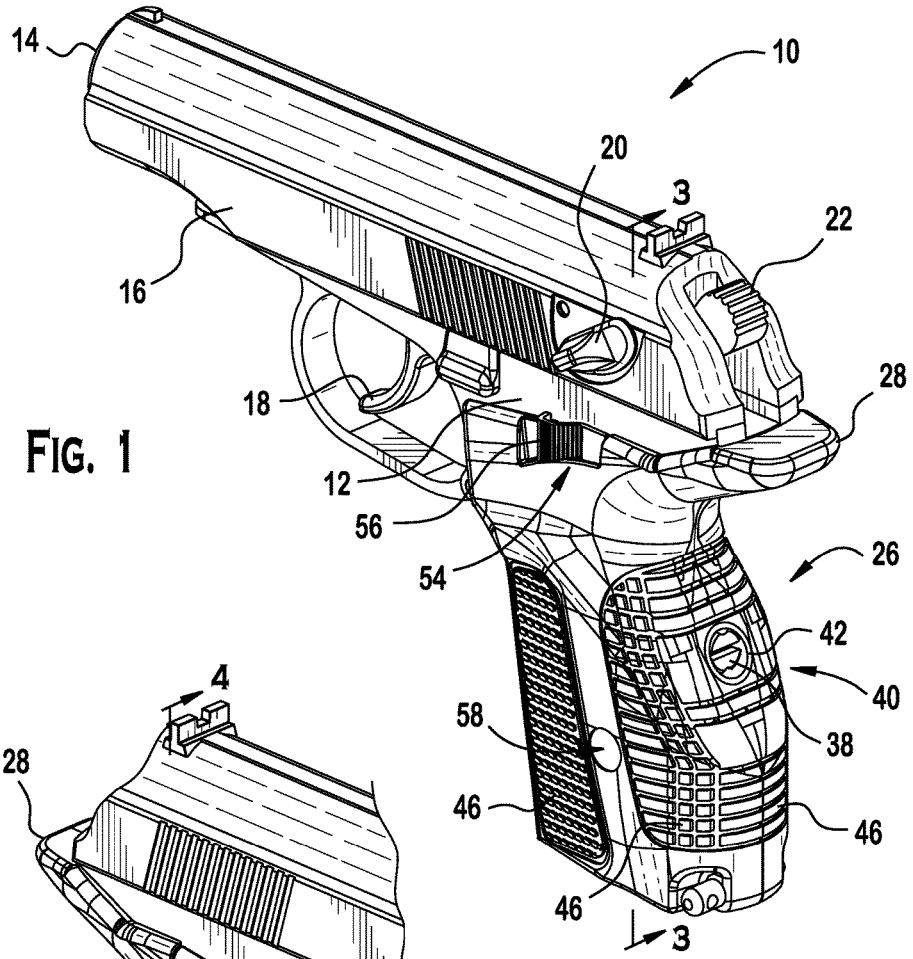
FIG. 1 is a perspective view of a Makarov pistol with an exemplary embodiment of a pistol grip and magazine catch release in accordance with a right-handed configuration of the present invention.

FIG. 1 shows a perspective view of a Makarov semi automatic pistol (MP) 10. Generally, the pistol is chambered for a 9×18 mm Makarov cartridge. Variants of the Makarov pistol, however, may be chambered for other ammunition (e.g., a .380 ACP cartridge). Preferably, the pistol frame 12, barrel and slide 14 may be formed from steel. The barrel 14 may be a fixed barrel that has a length of approximately 93.5 mm. The pistol may possess a double action trigger 18. Further, the pistol may include a manual safety 20. The manual safety 20 may be engaged when the safety is in a raised position and disengaged when the safety is in a lowered position. The safety may lock the hammer 22, sear, and slide 16 when engaged, thus preventing firing of the pistol. Generally, the pistol 10 may be loaded with a detachable box magazine 24 that is configured and dimensioned for use with the Makarov 9×18 mm cartridge. The magazine may be an 8-round magazine; however, the magazine may be configured to store other quantities of ammunition. For example, without limitation, the magazine may be a 10-round magazine or a 12-round magazine.

Figure 10:
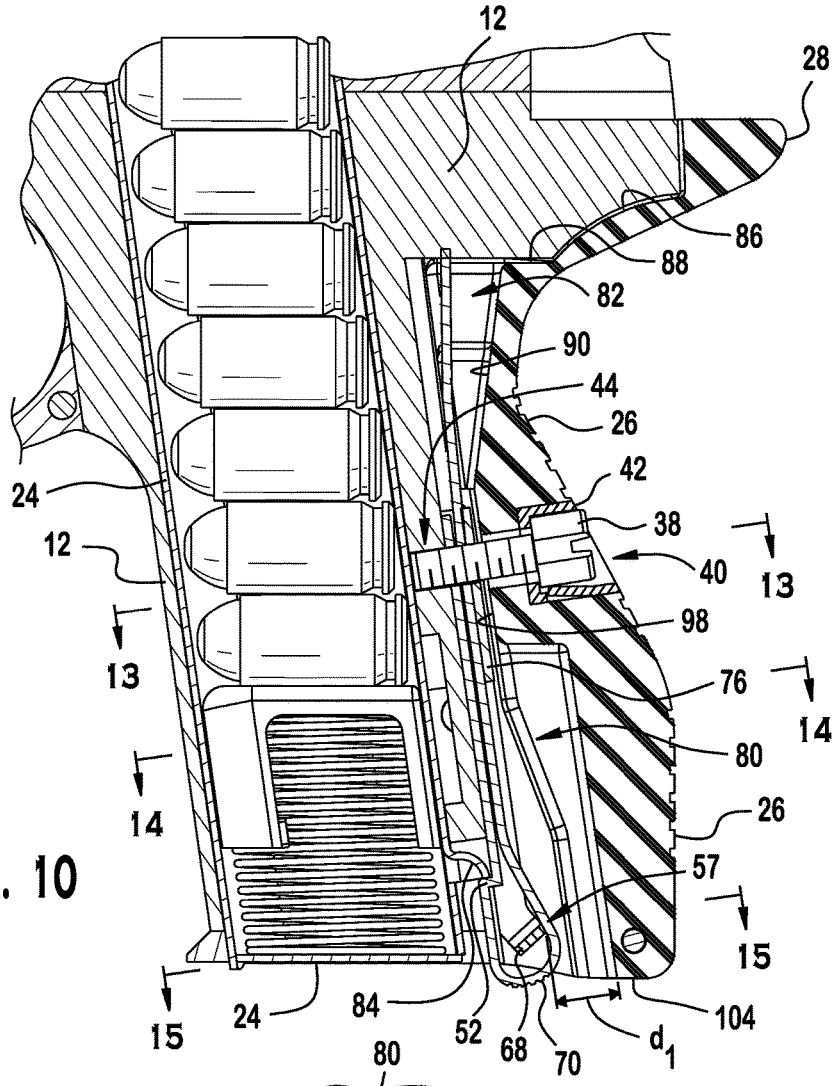
FIG. 10 is a left side partial sectional view of the pistol and pistol grip of FIG. 6, showing the magazine latch and catch in the engaged configuration.
Figure 12:
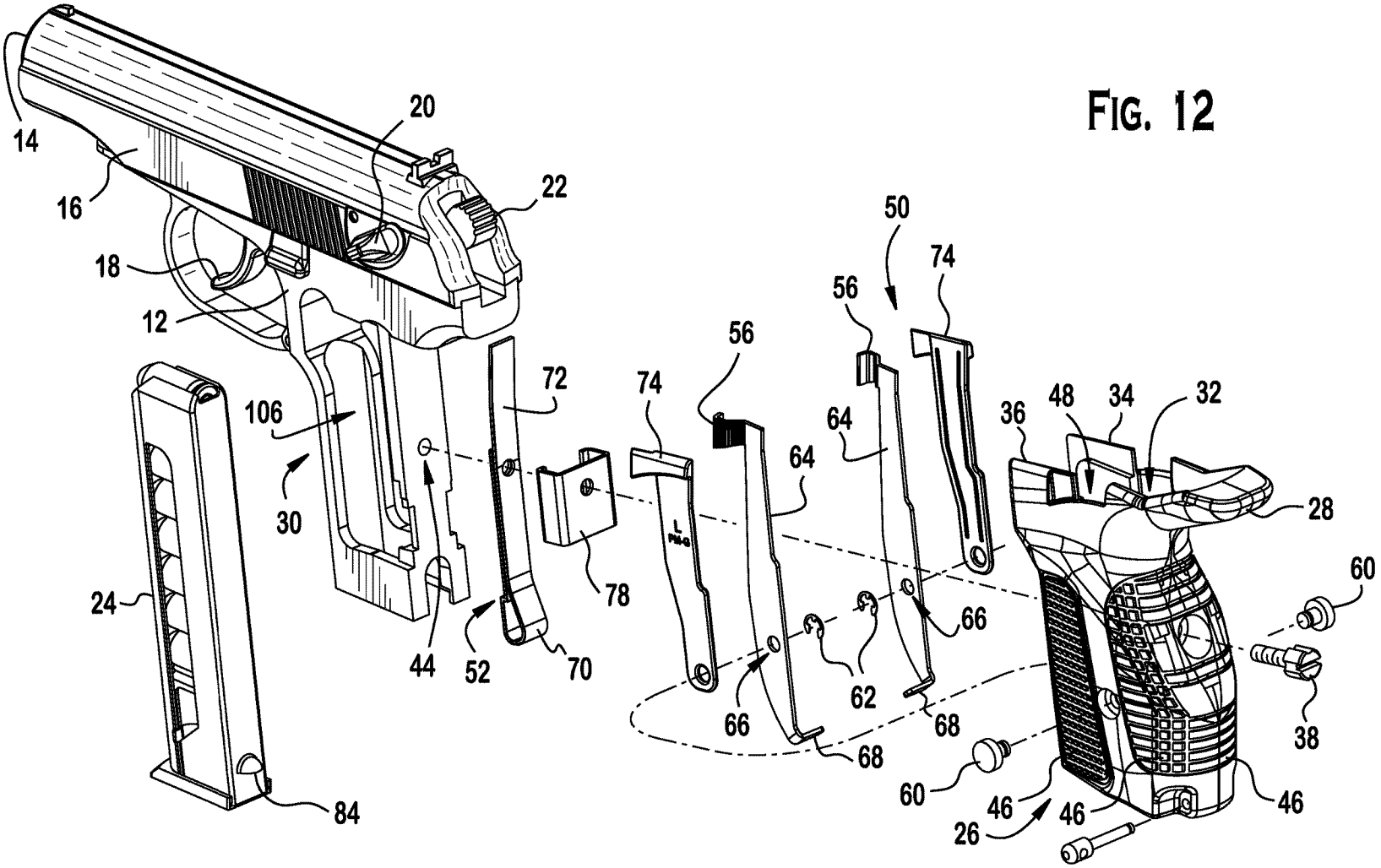
FIG. 12 shows an exploded view of modular components of the pistol grip in accordance with an exemplary embodiment of the present invention, along with selected features of a Makarov pistol.

Referring to FIG. 12, the pistol 10 may include a grip 26 that is secured to the frame 12 of the pistol. The grip 26 may include a Beavertail 28. The grip may wrap around three sides of a lower portion 30 of the frame 12. For example, the grip 26 may have a rear wall 32 and two opposing side walls 34, 36 such that a cross-section taken perpendicular to the longitudinal axis of the grip may be generally U-shaped. The bottom of the grip may be open such that a detachable box magazine may be loaded or removed from the lower portion of the pistol frame. Referring to FIG. 10, the grip 26 may be secured to the frame 12 via a grip screw 38 that is disposed within a bore 40 in a portion of the grip and which extends into the frame of the pistol. The bore (or fastener connection site) on the grip may include a grip screw detent bushing 42. The grip screw 38 may be advanced through the grip screw detent bushing 42 until the threaded portion of the screw securely mates with a receiving bore 44 on the pistol frame.

Although the grip 26 may be of unitary construction (i.e. one structural body), the grip may be composed of two or more pieces, provided that the component parts may be assembled into to a secure and stable grip. For example, the grip may be formed of two halves that may be secured to each other by one or more fasteners (e.g. a machine screw). Also, the grip 26 may be formed from one or more materials e.g. metal, metal alloys, wood, plastic, polymer materials, reinforced polymer materials, thermoplastic materials, and combinations thereof.

The exterior surface of the grip may include textured regions 46 to enhance the stability, gripping characteristics, or ergonomic fit of the pistol grip. The grip 26 may include an interior space (e.g., a generally U-shaped channel) 48 that is configured and dimensioned to mount on the lower portion (or handle) of the frame. Additionally, the grip 26 may present one or more mechanisms 50 that may be used to release the magazine catch 52 that is located near the base of the grip. In the disclosed embodiment, the mechanism includes a lever. Other mechanical or electromechanical mechanisms also may be used provided they provide a secure and reliable device for selectively releasing the magazine catch.

Figure 2:
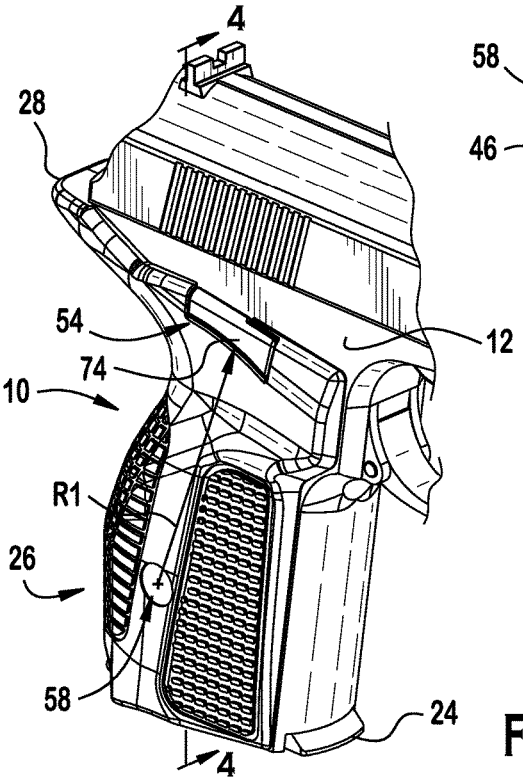
FIG. 2 is another perspective view of the pistol and pistol grip of FIG. 1.

Referring to FIG. 1 and FIG. 2, each side of the grip 26 may include an indentation (or cut out) 54 at the top of each side wall. The indentation 54 may be shaped and dimensioned to receive a thumb lever 56. The bottom of the indentation may be curved. As shown in FIG. 2, the curve may have a radius R1 that is centered about the pin 58 of the shim 74 (or thumb lever 56). A thumb lever 56 may present a textured curved paddle that extends away from the slide. Referring to FIGS. 5, 8, 9 and 12, each side of the grip 26 may include an aperture 58, which extends from the outer surface of the grip to the interior of the grip (or U-Shaped channel). Each aperture 58 may be a countersunk opening for receiving a pin 60. The pin may include a retention element (e.g., a C-clip) 62, press-fit closure, or another securing device.

Figure 3:
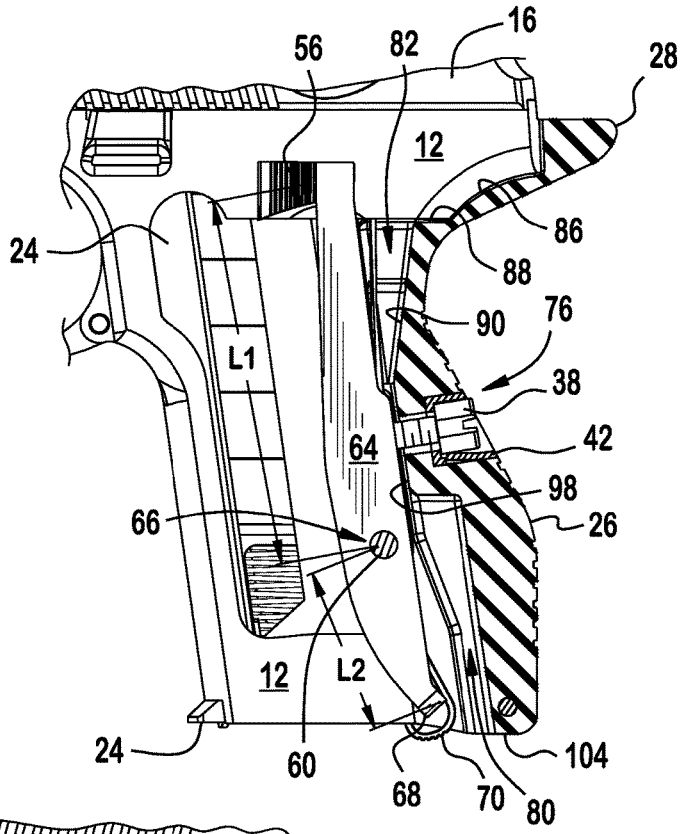
FIG. 3 is a cross-sectional view of FIG. 1 along line 3-3.

Referring to FIGS. 3, 5, 7, 8 and 9, the thumb lever 56 may be connected to a lever arm (or magazine catch release) 64 that is pinned to the grip at one of the apertures 58 with a retention element. The pin (or fastener) 60 may be inserted through an attachment site (e.g., hole) 66 in the lever arm 64 to form a pivot for the thumb lever 56. The lower end of the lever arm may include a projection (e.g., a hook) 68. As illustrated in dashed lines in FIGS. 15, 16 and 17, the projection 68 may be inserted inside the loop 70 of the hammer and trigger spring 72 such that when the thumb lever 56 is pushed forward by a user the lever arm 64 pivots about the pin, thereby causing the projection 68 to pull the loop 70 away from the frame. Referring to FIG. 3, the ratio of output to input force of the lever 64 may be given by the ratio of the distances L1 and L2 from the fulcrum 60 to the points of application of these forces. In the disclosed embodiment, the distance L1 is approximately 2.2" and the distance L2 is approximately 1.0". Accordingly, the mechanical advantage of the catch release lever may be approximately 2.2.

Referring to FIGS. 2, 4, 6 and 12, a shim 74 may be positioned in either indentation (or cut out) 54 and secured to the aperture 58 in order to close the indentation 54 of the grip. Preferably, the shim 74 and the shim fastening pin 60 generally conform to the local contours of the grip 26 so as to preserve any ergonomic benefit of the grip profile. Additionally, in other embodiments the indentation 54 may be a hole in the body of the grip.

Figure 5:
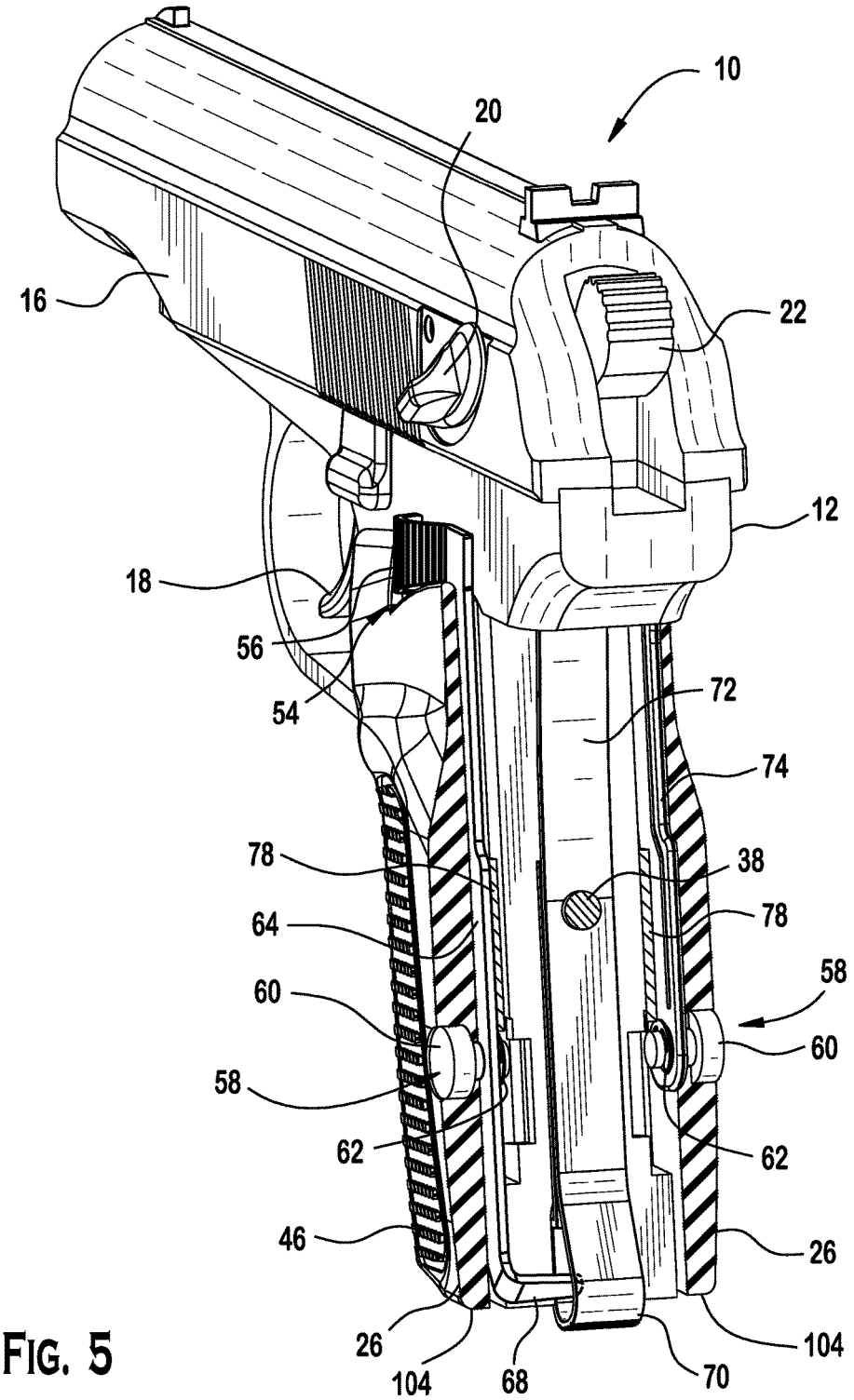
FIG. 5 is a rear perspective view of the pistol and a partial sectional view of the pistol grip of FIG. 1.
Figure 6:
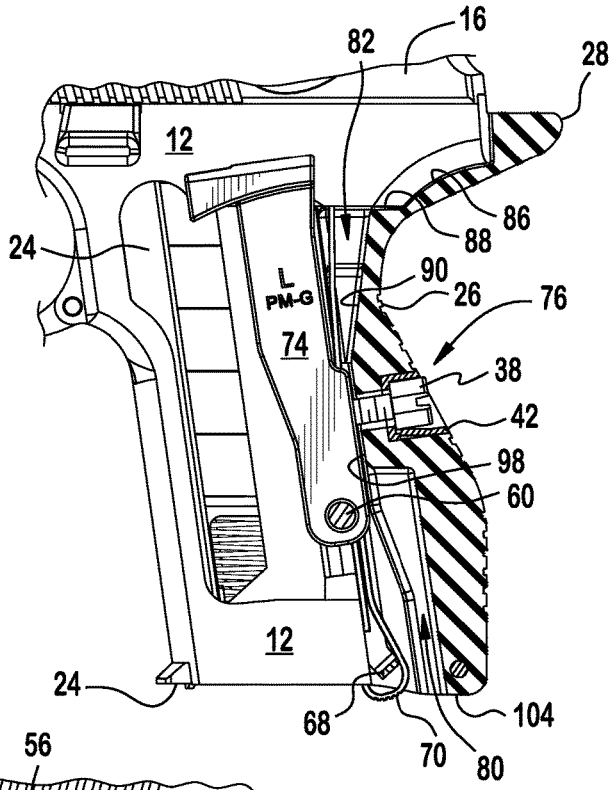
FIG. 6 is a left side view of the pistol and a partial sectional view of an exemplary embodiment of a pistol grip in accordance with a left-handed configuration of the present invention.
Figure 7:
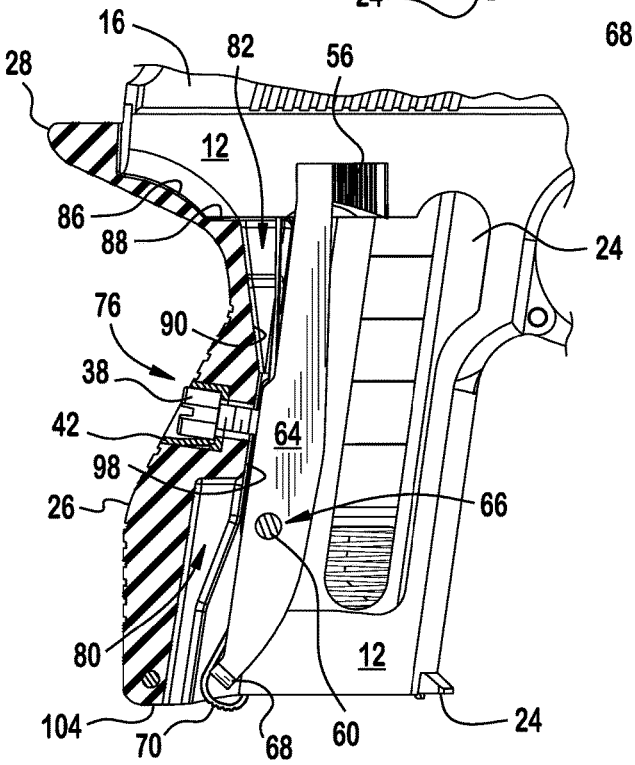
FIG. 7 is a right side view of the pistol and a partial sectional view of the pistol grip of FIG. 6.
Figure 8:
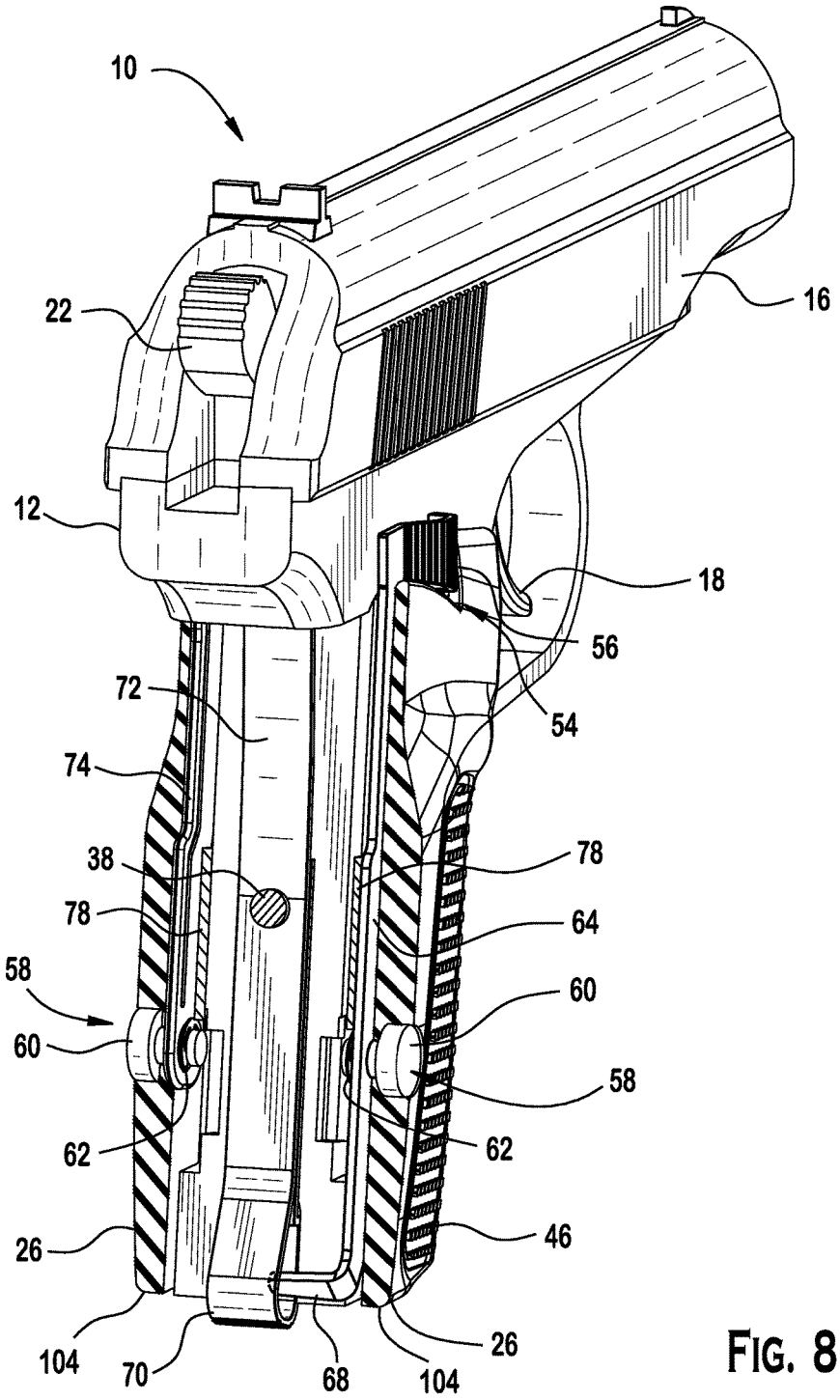
FIG. 8 is a rear perspective view of the pistol and a partial sectional view of the pistol grip of FIG. 6.
Figure 9:
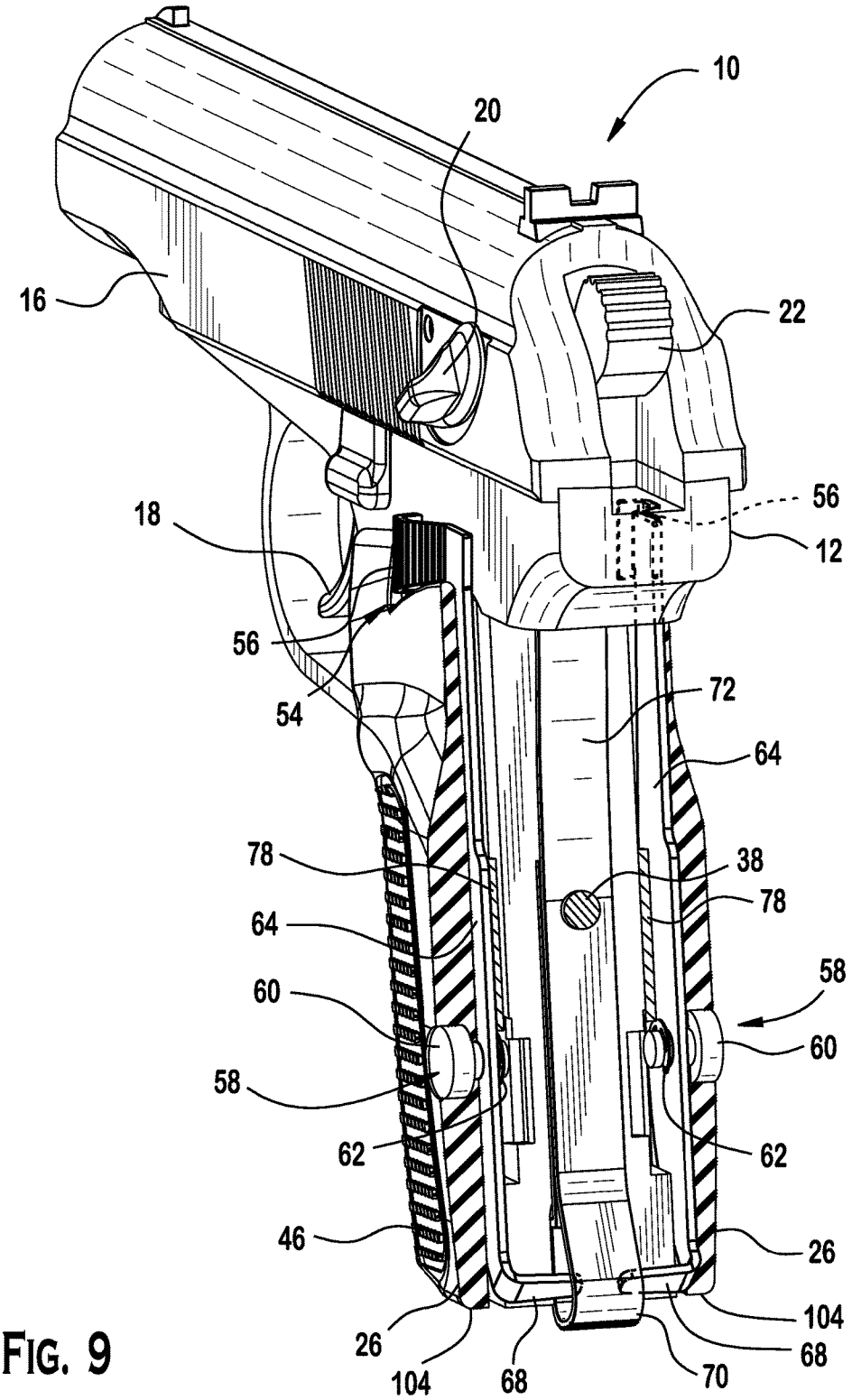
FIG. 9 is a rear perspective view of the pistol and a partial sectional view of an exemplary embodiment of a pistol grip in accordance with an ambidextrous configuration of the present invention.

As shown in FIGS. 2, 3 and 5, the thumb lever 56 may be situated below the manual safety 20. In this first configuration (i.e., a right-handed configuration), the thumb lever 56 may be connected to the port side of the grip for operation by an operator having a right dominant hand. Referring to FIGS. 7 and 8, the thumb lever 56 may be situated on the opposite side of the frame. In this second configuration (i.e., a left-handed configuration), the thumb lever 56 may be connected to the starboard side of the grip for operation by an operator having a left dominant hand. As shown in FIG. 9, one thumb lever 56 may be positioned in each of the respective indentations 54 and secured to the respective apertures 58 on the right and left side walls of the grip. In this third configuration (i.e., an ambidextrous configuration), the thumb levers 56 may be equally suitable for an operator having a right or left dominant hand.

Figure 4:
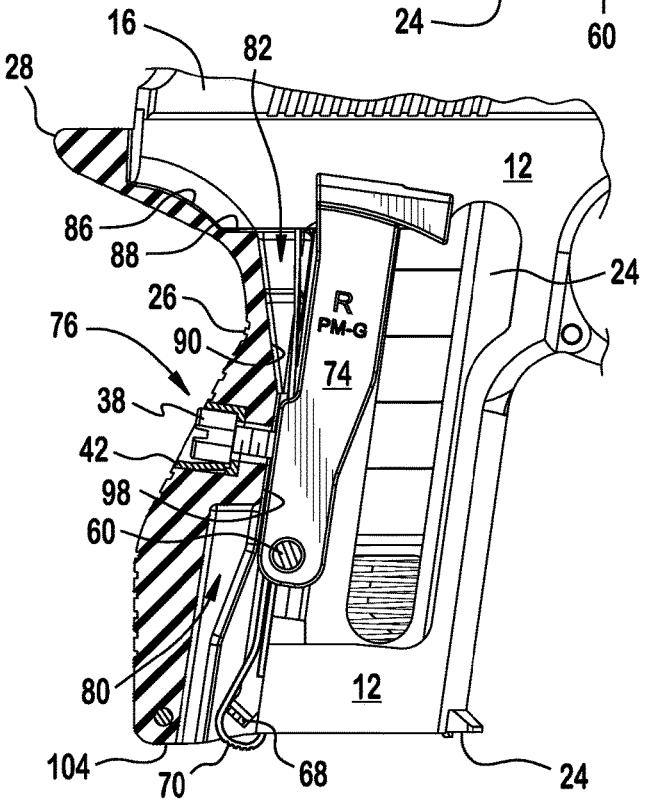
FIG. 4 is a cross-sectional view of FIG. 2 along line 4-4.
Figure 13:
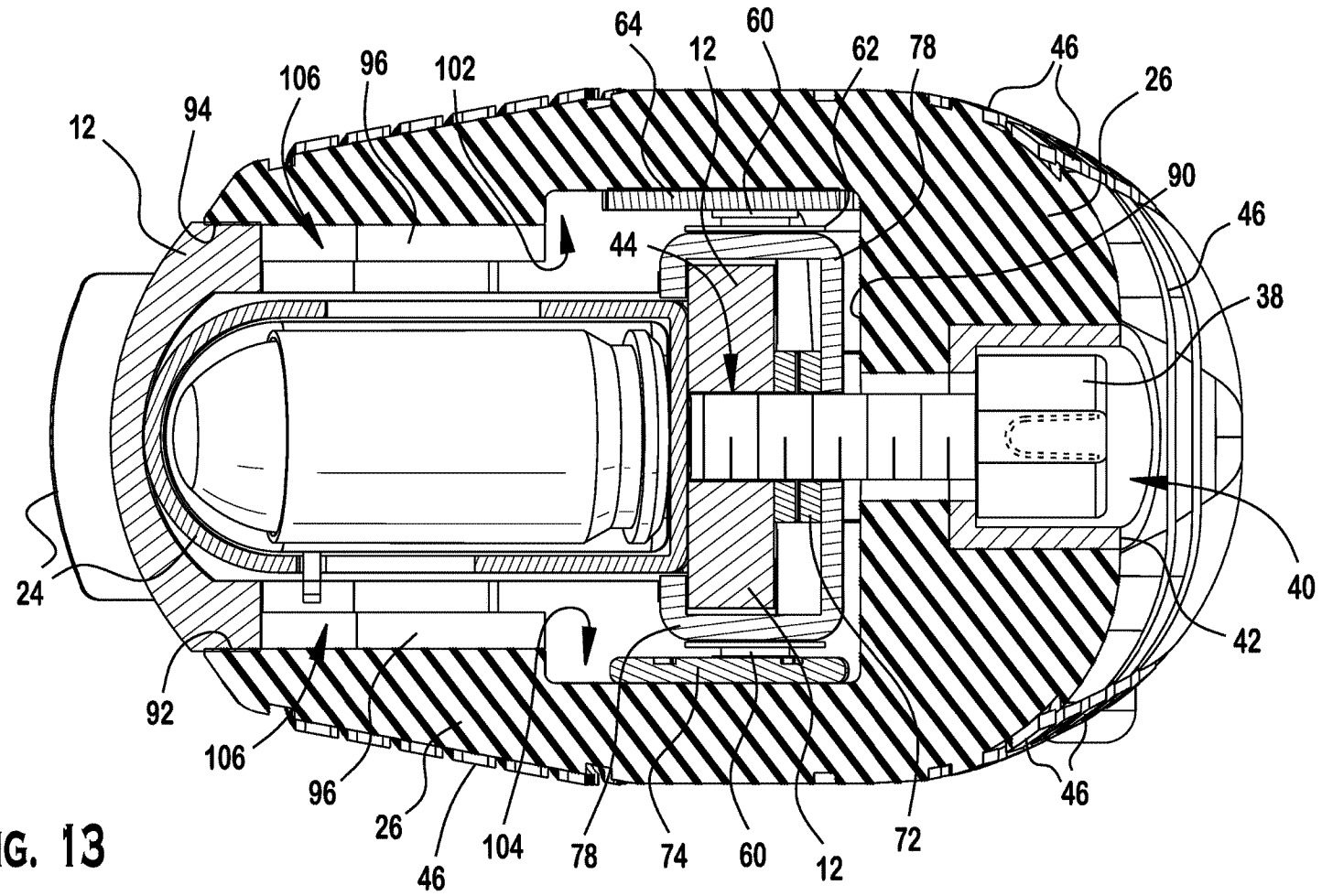
FIG. 13 is a cross-sectional view of the Makarov pistol and grip of FIG. 10, along line 13-13.

Referring to FIGS. 3 and 4, the rear wall of the grip 26 further may include a passage 40 which extends from the outer surface of the grip to an inner surface which opens to the interior of the grip (or U-shaped channel) 48. Referring to FIG. 13, the passage may vary in dimension along its longitudinal axis. For example, the passage 40 may include a segment formed by a relatively large diameter bore and another segment formed by a relatively smaller diameter bore. A grip screw detent bushing 42 may be positioned in the first segment, and a grip screw 38 may be advanced into the passage 40 and threaded into a hole 44 with mating screw threads in the frame. Additionally, the grip screw 38 may pass through a spring retainer 78 such that the grip screw 38 secures the hammer and trigger spring 72, the spring retainer 78, and the grip 26 to the frame 12 of the pistol.

Figure 11:
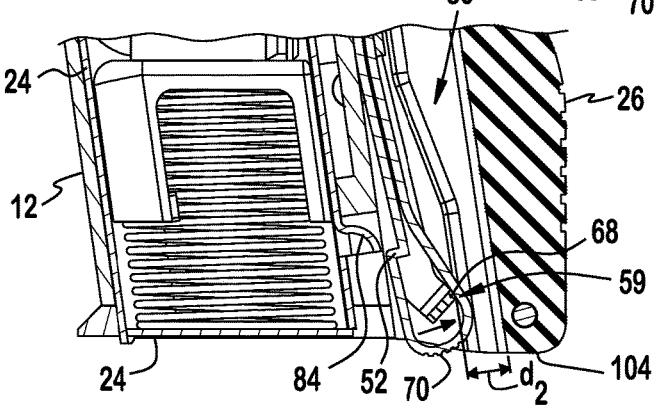
FIG. 11 is another view of the pistol and pistol grip of FIG. 10, showing the magazine latch and catch in the disengaged configuration.
Figure 15:
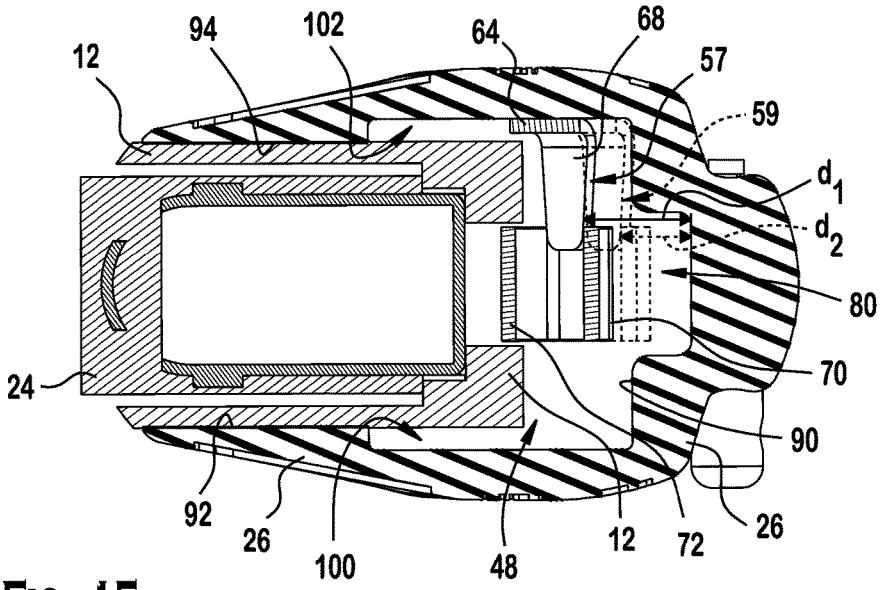
FIG. 15 is a cross-sectional view of the Makarov pistol and grip of FIG. 10, along line 15-15.
Figure 16:
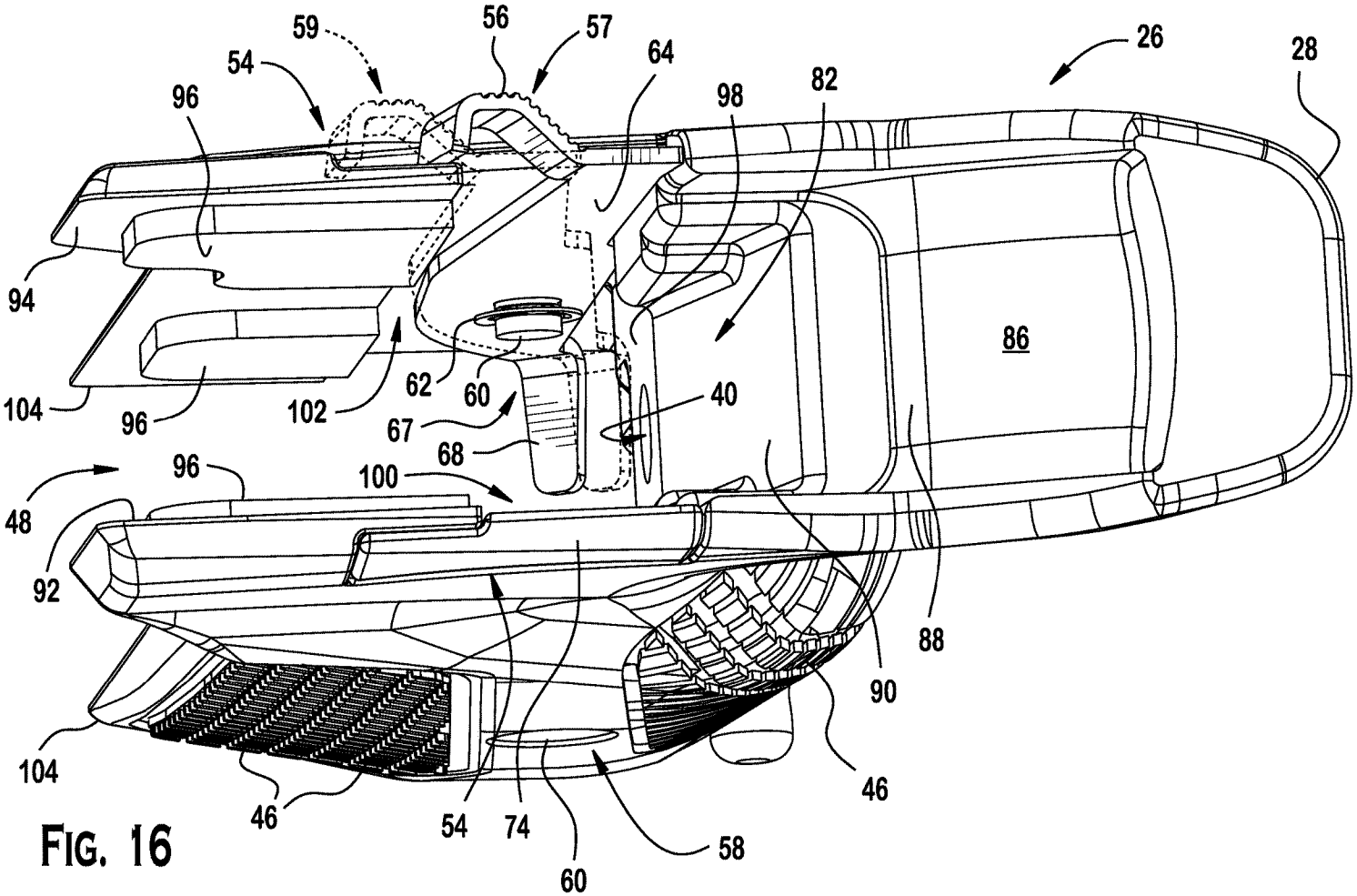
FIG. 16 is a perspective view of the pistol grip of FIG. 1.
Figure 17:
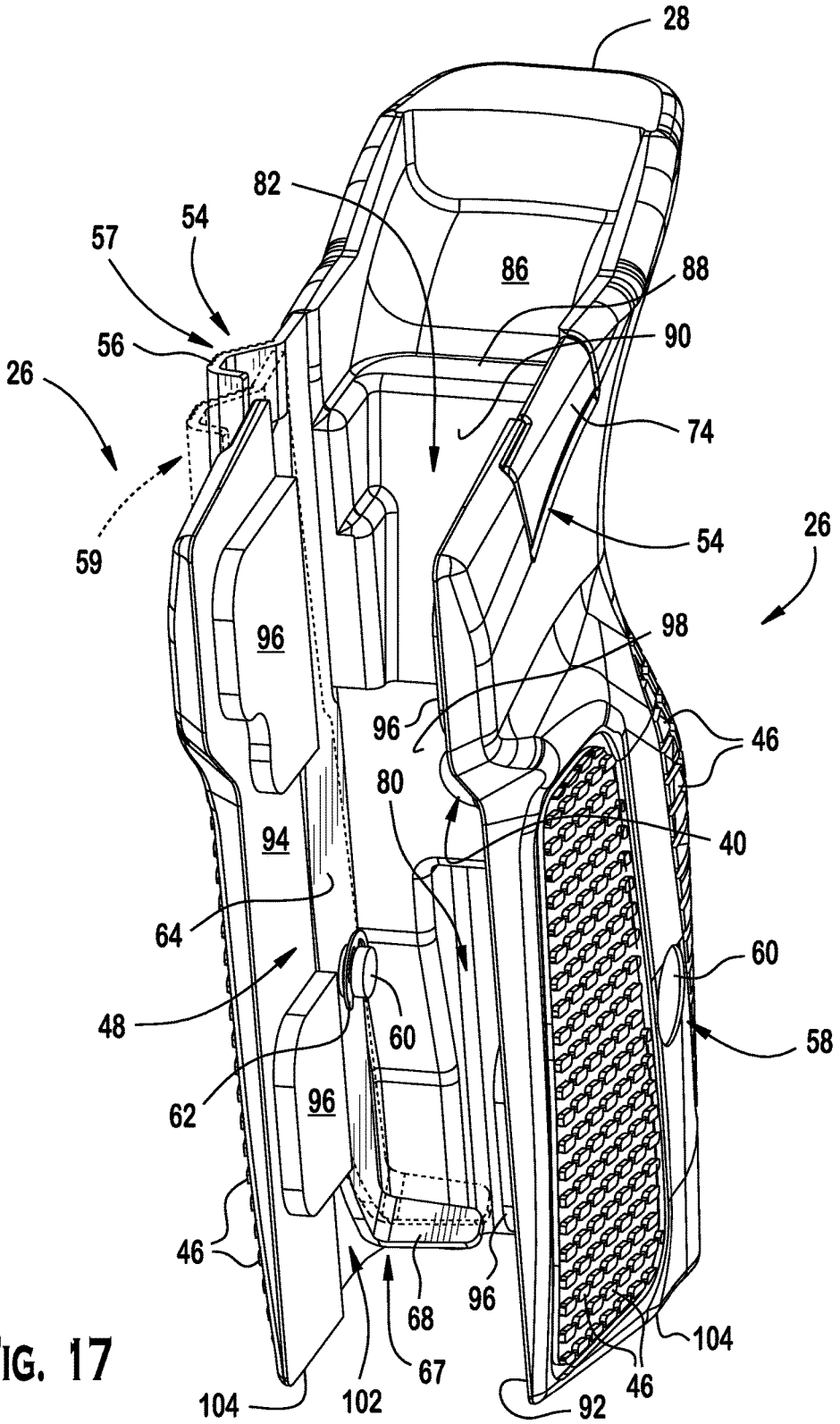
FIG. 17 is another perspective view of the pistol grip of FIG. 16.

Referring to FIG. 10, the grip 26 may include an inferior pocket (or magazine catch well) 80 at the base (or heal) of the grip and a superior pocket (or hammer and trigger spring action well) 82 near the top of the grip. The inferior pocket 80 may surround the lower portion of the hammer and trigger spring 70. The inferior pocket 80 may provide room for the loop 70 of the hammer and trigger spring 72 to flex (or move) rearward. By contrast, the superior pocket 82 may be situated adjacent an upper portion of the hammer and trigger spring 72 and may provide clearance sufficient for the upper portion of the hammer and trigger spring to flex (or oscillate) during normal operation of the pistol. Referring to FIGS. 10, 11, and 15, moving the loop 70 away from the frame 12 with the projection 68 may cause a stepped feature in the loop 56 to disengage with a projection (or latch) 84 on the rear wall of the magazine 24. When the catch and latch disengage, the magazine may be withdrawn (or removed) from the lower portion of the frame. For example, as shown in FIG. 16 and FIG. 17, the grip body 28 may include a first lever 64 connected to the first interior side wall 94, the first lever including a first end portion 56 adjacent the top end portion of the body and a second end portion 67. The second end portion 67 may include a projection 68 extending toward the second interior side wall 92. As shown in FIG. 9, the first lever 64 further may include a first interior side wall attachment site 58. Referring to FIG. 16 and FIG. 17, the first lever 64 may be movable between a first position 57 and a second position 59. As shown in FIG. 10 and FIG. 15, in the first position 57 the projection 68 is spaced a first distance $d_1$ from the third interior side wall 90. As shown in FIG. 11 and FIG. 15, in the second position 59 the projection 68 is spaced a second distance $d_2$ from the third interior side wall 90, the second distance being less than the first distance.

Referring to FIGS. 16 and 17, the interior space 48 of the pistol grip may be configured to mate with the frame, as well as house the magazine catch release thumb lever 64 catch release and shim 74 mechanisms. The interior space 48 may be defined by a generally three-sided channel that is shaped to mate with features of the frame in order to provide a secure connection between the pistol and the grip 26. For example, a convex interior surface 86 and ledge 88 on the rear interior side wall 90 may be shaped to support the proximal end of the slide. Additionally, the internal sidewalls on the port side 92 and the starboard side 94 of the generally three-sided channel may include raised surfaces 96 that are shaped to fit within shaped openings within the frame. The raised surfaces 96 may mirror openings in the frame. For example, the raised surfaces may possess similar dimensions, orientation and shape as the openings such that the raised surfaces may be inserted into the openings to interlock with the frame.

Figure 14:
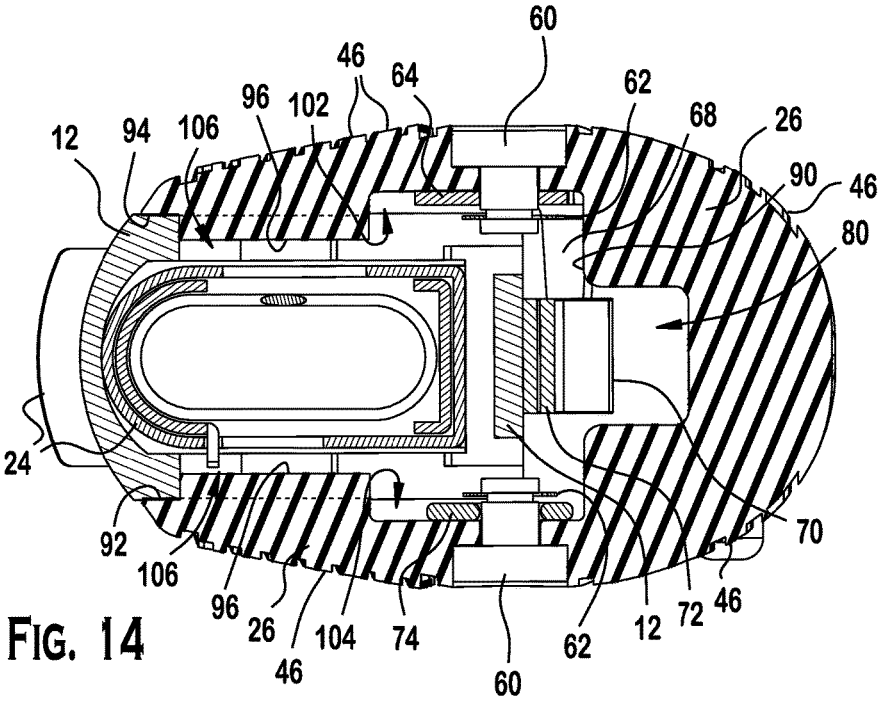
FIG. 14 is a cross-sectional view of the Makarov pistol and grip of FIG. 10, along line 14-14.

The internal sidewall on the rear side 90 of the generally three-sided channel may include the superior well (or pocket) 82 and the inferior well (pocket) 80. The superior well 82 may be configured and dimensioned to accommodate movement of the hammer and trigger spring (not shown) during operation of the firearm. Referring to FIGS. 14, 15, and 17 the inferior well 80 may be configured and dimensioned to accommodate movement of the magazine catch release action arm projection 68 and hammer and trigger spring 72 such that when the hook 68 is oscillated away from the frame 12, the loop 70 of the hammer and trigger spring 72 is pulled away from the frame 12 to disengage the catch 52 from the latch (or projection) 50 on the magazine 24 to unlock the magazine 24 from the pistol 10.

Referring to FIG. 17, an intermediate region 98 of the rear internal side wall 90 of the generally three-sided channel is disposed between the superior well 82 and the inferior well 80 may be shaped to fit securely against the spring retainer. For example, the intermediate region may be generally flat and smooth. The grip screw receiving bore 44 may be situated in the intermediate region 98.

Referring to FIG. 16, the internal side walls of the port side 92 and the starboard side 94 of the generally three sided-channel may each respectively include an elongated recess 100, 102. Each elongated recess 100, 102 may extend from the bottom portion of the grip to the cut out. Each elongated recess 100, 102 may be located between the raised surfaces 96 and the rear interior side wall 90. The elongated recesses 100, 102 may include the bore 44 for the magazine catch release pivot pin or shim anchor pin.

Referring to FIG. 13, raised surfaces 96 on the internal side walls 100, 102 are disposed within openings 106 in the frame 12. On the starboard side internal side wall 94 of the grip, the lever arm 64 is pivotally secured within the elongated recess 102 by a pin 60 and retention element 92 such as a C-clip. On the port side internal side wall 92 of the grip, the shim 74 is fixed within the corresponding elongated recess 104 by another pin 60 and retention element 62. Disposed between the two elongated recesses 100, 102 is the spring retainer 78, the hammer and trigger spring 72, and frame 12. On the rear internal side wall 90 of grip, the grip screw receiving bore 40 is aligned with the hole 44 on the pistol frame. The grip screw is advanced though the grip receiving bore 40, the spring retainer 78, and the receiving hole 44 on the pistol frame to fix the grip 26 to the frame 12. The raised surfaces 96 on the internal sidewalls 92, 94 press against the front of the frame to further secure the connection between the grip 26 and the frame 12.

Referring to FIG. 14, the raised surfaces 96 are disposed within openings 106 in the frame 12 (see FIG. 12) of the pistol, and the hook 68 is inside the loop 70 of the hammer and trigger spring 72. The inferior well (or pocket) 80 is shown as well.

Referring to FIG. 15, as the loop 70 is pulled away from the frame 12 the lower part of the trigger and hammer spring 72 moves into this space so that the catch 52 on the loop 70 (see FIG. 12) may disengage from the magazine. The elongated recesses 100, 102 at the base of the grip widens to accommodate travel of the hook 68 and loop 70. The trigger and hammer spring 72 may bias the projection 68 toward the frame 12. Thus, movement of the loop away from the frame may work against the spring force of the trigger and hammer spring.

Figure 18:
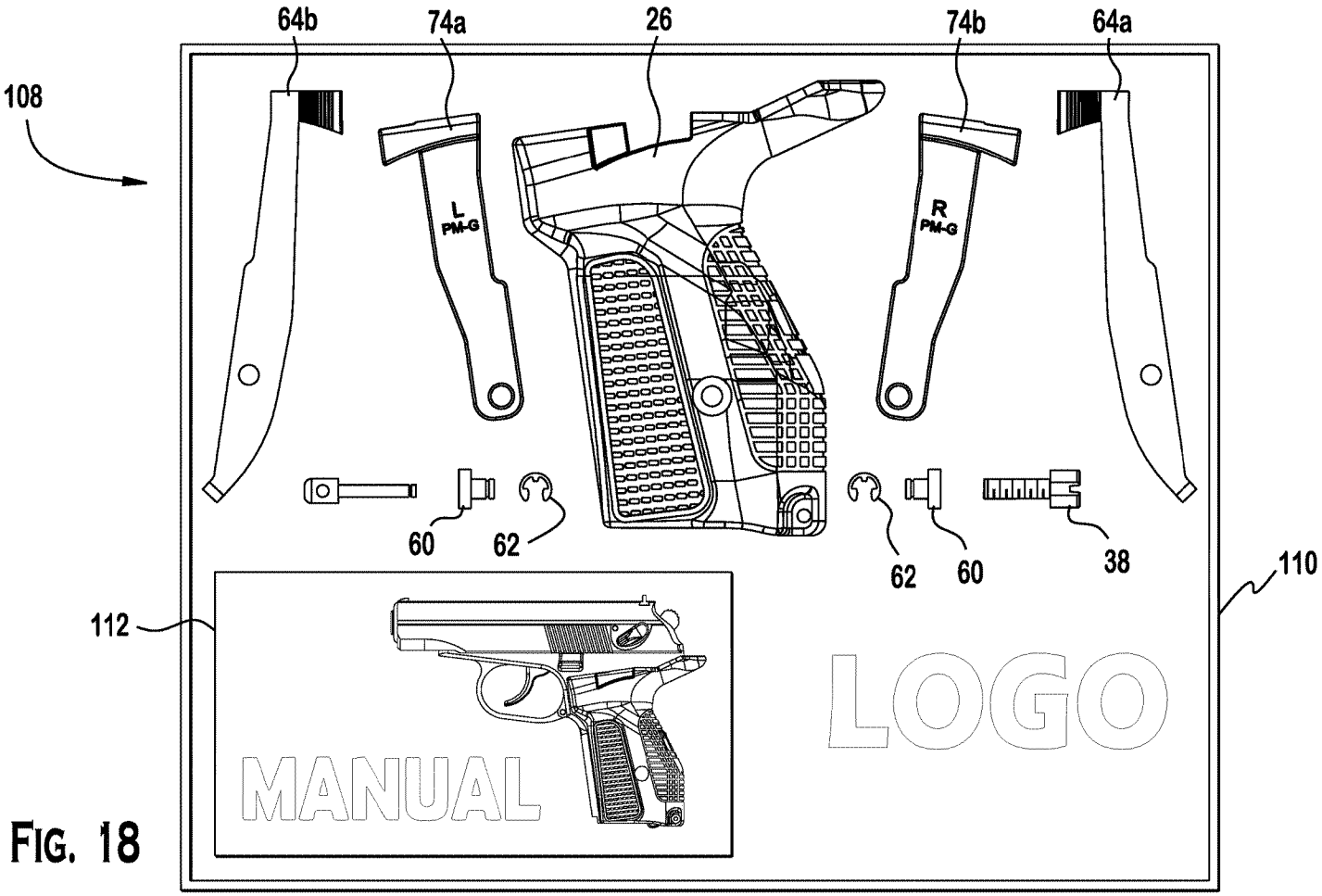
FIG. 18 is a schematic diagram of an exemplary pistol grip conversion kit for a Makarov pistol.

Referring to FIG. 18, the pistol grip 26 may be packaged in a pistol grip conversion kit 108, along with internal components to allow the pistol grip to be installed on a Makarov variant pistol. The internal components may include a port side shim 74*a*, a starboard side shim 74*b*, a port side magazine catch release lever 64*a*, and a starboard side catch release lever 64*b*. Additionally, the internal components may include a pair of fastening pins 60 and retention elements 62 for securing the shims and levers to the grip. The kit 108 may include a grip screw 38 for securing the grip to the frame, as well as a lanyard connection pin and retention element. The kit 108 may include instructions 112 for assembling the grip and installing it on a Makarov variant pistol.

For example, the instructions may include, without limitation, the following steps: removing the grip and internal components from the kit; visually inspecting the grip and the internal components removed from the kit; placing a magazine catch release lever in an elongated recess of an internal sidewall of the grip; positioning a portion of the magazine catch release lever in a cut out in the internal sidewall which is proximate to the elongated recess; inserting a pin through an aperture in the internal sidewall; inserting the pin through a hole in the magazine catch release lever; and securing the magazine catch release lever to the grip by connecting a retention element to the pin.

The instructions further may include placing a shim (or another catch release lever) in another elongated recess of the grip, the other elongated recess being disposed on another internal sidewall of the grip; positioning a portion of the shim (or other magazine catch release lever) in another cut out in the other internal sidewall which is proximate to the other elongated recess; inserting another pin through another aperture in the other internal sidewall; inserting the other pin through another through hole in the shim (or other magazine catch release lever); and securing the shim (or other magazine catch release lever) to the grip by connecting another retention element to the other pin.

The instructions further may include mounting the grip onto the frame of the pistol; positioning one (or more) raised surface(s) on the internal side wall(s) of the grip into a corresponding opening(s) in the frame; aligning the grip screw receiving bore on yet another internal side wall of the grip with a receiving bore on the pistol frame; advancing a grip screw though the receiving bore, the spring retainer and the trigger and the hammer spring of a Makarov variant pistol; and the receiving bore on the pistol frame to fix the grip to the frame and then securing the pistol to the frame by advancing a threaded fastener through the grip and into the frame. The instructions may include pulling the frame toward the rear internal side wall of the grip; and pressing the In use, an operator may push a thumb lever forward (i.e., toward the distal end of the pistol). This action rotates the magazine catch release about the magazine catch release pivot pin, which causes the hook to move away from the frame. Movement of the hook away from the frame draws the loop away from the frame as well. Sufficient movement of the hook away from the frame causes the catch on the loop to disengage with the magazine latch so that the magazine may be removed or changed. As the thumb lever is released from the actuated position by the operator, the loop and thumb lever may return to their initial positions under forces applied by the lower, displaced portion of the hammer and trigger spring.

While it has been illustrated and described what at present are considered to be preferred embodiments of the present disclosure, it will be understood by those skilled in the art that various changes and modifications may be made, and equivalents may be substituted for elements thereof without departing from the true scope of the invention. For example, the shape of the thumb lever or indentations may be modified for ergonomic or operational considerations. Also, different fastening means may be used to connect the catch release levers and shims to the body of the grip. In one example, the catch release lever may be snap fit mounted on to a projection of the interior side wall of the body. In another example, the catch release lever and shim may include a projection that is press fit into a mating recess in the interior side wall of the body. Additionally, features and or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A grip for a gun, the gun including a frame having an upper portion and a lower portion, a slide connected to the upper portion of the frame, an ammunition magazine receptacle situated within the lower portion of the frame, and a spring secured to the frame, the spring including a lower end adjacent to the lower end portion of the frame, the grip for the gun comprising:

- a body which comprises
  - a top end portion,
  - a bottom end portion spaced from the top end portion along a first longitudinal axis,
  - an exterior surface extending from the top end portion to the bottom end portion,
  - a first interior side wall,
  - a second interior side wall opposite the first interior side wall, and
  - a third interior side wall disposed between the first interior side wall and the second interior side wall, the third interior side wall comprising
    - an intermediate region,
    - a bore extending from the exterior surface to the intermediate region, and
    - an inferior pocket located between the intermediate region and the bottom end portion;
- a first lever connected to the first interior side wall, the first lever comprising
  - a first end portion adjacent the top end portion of the body, a second end portion, proximate the bottom end portion, which comprises a projection extending toward the second interior side wall, and a first interior side wall attachment site located between the first end portion and the second end portion, the first lever being movable about the first interior side wall attachment site between a first configuration and a second configuration such that in the first configuration the projection is spaced a first distance from the third interior side wall, and such that in the second configuration the projection is spaced a second distance from the third interior side wall, the second distance being less than the first distance.

2. The grip of claim 1, wherein the first interior side wall comprises a first elongated recess and the first lever is connected to the first interior side wall within the first elongated recess.

3. The grip of claim 2, wherein the first elongated recess comprises a front wall adjacent the first interior side wall, and a rear wall adjacent the first interior side wall, the first lever being pivotally connected to the first interior side wall such that in the first configuration the first end portion is proximate the rear wall, and such that in the second configuration the first end portion is proximate the front wall.

4. The grip of claim 1, wherein the first lever has a mechanical advantage greater than 1.0.

5. The grip of claim 2, wherein the first lever has a mechanical advantage greater than 2.0.

6. The grip of claim 5, wherein the first lever has a mechanical advantage substantially equal to 2.2.

7. The grip of claim 1, wherein the first end portion comprises an actuation surface.

8. The grip of claim 7, wherein the actuation surface projects away from the exterior surface.

9. The grip of claim 8, wherein the body further comprises a first opening extending from the exterior surface to the first interior side wall, and the actuation surface is in the first opening.

10. The grip of claim 9, wherein the first opening is an indentation in the top end portion of the body.

11. The grip of claim 9, wherein the first opening comprises a rim extending from the exterior surface to the first interior side wall.

12. The grip of claim 11, wherein the rim forms a curve.

13. The grip of claim 12, wherein the curve has a radius centered at the first interior side wall attachment site.

14. The grip of claim 13, wherein the radius is substantially equal to 50 mm.

15. The grip of claim 1, wherein the body further comprises a port side, and the first interior side wall is on the port side.

16. The grip of claim 15, further comprising a shim connected to the second interior side wall.

17. The grip of claim 1, wherein the body further comprises a starboard side, and the first interior side wall is on the starboard side.

18. The grip of claim 17, further comprising a second lever connected to the second interior side wall.

19. The grip of claim 17, further comprising a shim connected to the second interior side wall.

20. A pistol grip conversion kit for a pistol comprising:

a grip of claim 1;

a second lever configured and dimensioned to be connected to the second interior side wall;

a first shim configured and dimensioned to be connected to the first interior side wall;

a second shim configured and dimensioned to be connected to the second interior side wall; and instructions for replacing a pistol grip with the grip of claim 1.

* * * * *